United States Patent [19]

Rabinowitz

[11] 3,936,091

[45] Feb. 3, 1976

[54] HEADREST FOR DENTAL CHAIR

[75] Inventor: Azriel Jay Rabinowitz, Rochester, N.Y.

[73] Assignee: Sybron Corporation, Rochester, N.Y.

[22] Filed: Dec. 23, 1974

[21] Appl. No.: 535,733

[52] U.S. Cl. ..... 297/188; 297/408

[51] Int. Cl.[2] ..... A47C 7/62

[58] Field of Search..... 297/188, 191, 391, 408–410

[56] References Cited

UNITED STATES PATENTS

| | | | |
|---|---|---|---|
| 2,652,101 | 9/1953 | Samsky et al. | 297/409 X |
| 3,198,574 | 8/1965 | Ota et al. | 297/391 X |
| 3,224,809 | 12/1965 | Thompson | 297/391 |
| 3,386,766 | 6/1968 | Gorelick | 297/191 X |
| 3,477,761 | 11/1969 | Krantz | 297/410 |
| 3,603,642 | 9/1971 | Laessker | 297/408 |
| 3,817,576 | 6/1974 | Ciavattoni et al. | 297/408 |

*Primary Examiner*—James C. Mitchell
*Attorney, Agent, or Firm*—Theodore B. Roessel; Papan Devnani

[57] ABSTRACT

An adjustable headrest for use with the dental chairs and the like which can be tilted forward or backward with respect to the backrest of the chair. The headrest is adjusted with one hand by vertically pulling a lever to disengage a clutch mechanism while simultaneously moving the headrest to the selected inclination.

11 Claims, 2 Drawing Figures

HEADREST FOR DENTAL CHAIR

BACKGROUND OF THE INVENTION

The present invention relates to an adjustable headrest for dental chairs and more specifically to such a headrest which can be operated with one hand.

Most present type adjustable headrests known in the art need both hands to operate, one hand to hold the headrest in a selected position and the other hand to operate the locking mechanism. For various reasons it is advantageous to have the headrest operable with one hand so that the dentist will have one hand free to hold an instrument, the head of the patient or for various other purposes.

Headrests are known, which are operable with one hand, as for example the headrest shown in U.S. Pat. No. 3,817,576. One drawback of such a headrest of the prior art is that a pawl mechanism used to lock the headrest limits positioning to a relatively few predetermined positions throughout the range of movement. Also, the headrest and the lever for operating the lock mechanisms are pivotable about different points which results in a relative movement between the headrest and lever during repositioning. In some instances this relative movement makes the headrest awkward to operate.

In the presently available headrests, the pivot point of the headrest is close to the joint between the patient's head and neck, that is near the plane of the oral cavity. As a result, when the headrest is rotated, the head simply rotates on the neck column. Since the radius length defined by the distance between the pivot point of the headrest and the oral cavity is relatively short, the position of the patient's oral cavity does not significantly change.

In the articulated headrest of the present invention the lock mechanism for operation is contained in the headrest. Disengagement of the lock and repositioning the headrest is accomplished by operating a bar at the back of the headrest with the fingers of one hand while articulating the headrest with the same hand up or down to get the desired position. Releasing the bar then locks the headrest in that particular position. The locking mechanism used in the present invention not only permits a greater freedom in positioning of the headrest within its range of movement but also is readily accessible to both the dentist or hygienist regardless of whether the patient is in a supine or upright position and regardless of whether the dentist or hygienist is at the left or right side of the dental chair.

Further, in the present invention, the pivot point of the headrest is located not near the patient's mouth but well below the patient's occipital such that it closely coincides with the actual pivot point of a patient's neck. As a result, when the headrest is articulated, the patient's entire neck column is bent. Since the radius length defined by the distance between the pivot point of the headrest and the oral cavity is now relatively long, the patient's oral cavity tends to rotate a greater distance for better visibility to the dentist.

As an added feature, the headrest includes a bracket which can be used to hold instruments and their accessories.

SUMMARY OF THE INVENTION

In the present invention, the headrest is journaled to a tang which in turn can be inserted into the backrest of a dental chair, a lock mechanism within the headrest includes a first toothed clutch member fixed to a tang, coaxial with a headrest journal, and a manually movable bracket which is slidably mounted within the headrest for movement in a direction normal to the axis of the journal, the bracket having a cam slot. A lever arm is pivoted intermediate its ends to the headrest, the lever arm carrying a second toothed clutch member at one end and a cam follower at its other end riding in the bracket cam slot. A bias means urges the toothed clutch members together for locking the headrest in position, the clutch members being disengaged by manually moving the bracket upwardly which causes the cam slot-cam follower connection to pivot the lever arm and move the second clutch member away from the first.

When used in combination with a dental chair having its back rest provided with a cut out portion to receive the tang, the articulation point of the headrest can be located well below the end surface of the backrest so that the articulation of the headrest produces the dual movement of bending the patient's neck column and rotating the head on the neck column as opposed to headrests of the prior art which merely rotate the head.

As an added feature, the top section of the headrest contains a sleeve adapted to receive an instrument parking bracket inserted into the sleeve from either side of the headrest for temporarily supporting various dental instruments such as drills, syringes and the like.

OBJECTS OF THE PRESENT INVENTION

One object of the present invention is to provide an articulated headrest for dental chairs and the like wherein the mechanism for locking the headrest in the desired position is wholly contained within the headrest.

Another object of the present invention is to provide an articulated headrest for dental chairs and the like which allows free movement in an upward direction and automatically locks the headrest against downward pressure.

A further object of the present invention is to provide an articulated headrest which can be easily operated by one hand.

A still further object of the present invention is to provide a locking mechanism for an articulated headrest and the like which allows adjustment to a relatively large number of positions over the range of movement of the articulated headrest.

Another object of the invention is to provide a headrest which incorporates an instrument parking bracket to hold instruments so designed as not to interfere with the dentist's legs when operating upon a patient resting in supine position.

It is still another object of the invention to provide a headrest in which there is no relative movement between the headrest and operating lever when the headrest is adjusted.

Yet another object of the invention to provide a headrest which maintains a patient's head in one orientation without varying the position of his oral cavity.

The invention will be better understood and additional objects thereof will become more apparent from the accompanying specification and claims considered together with the accompanying drawings.

Figure 1:
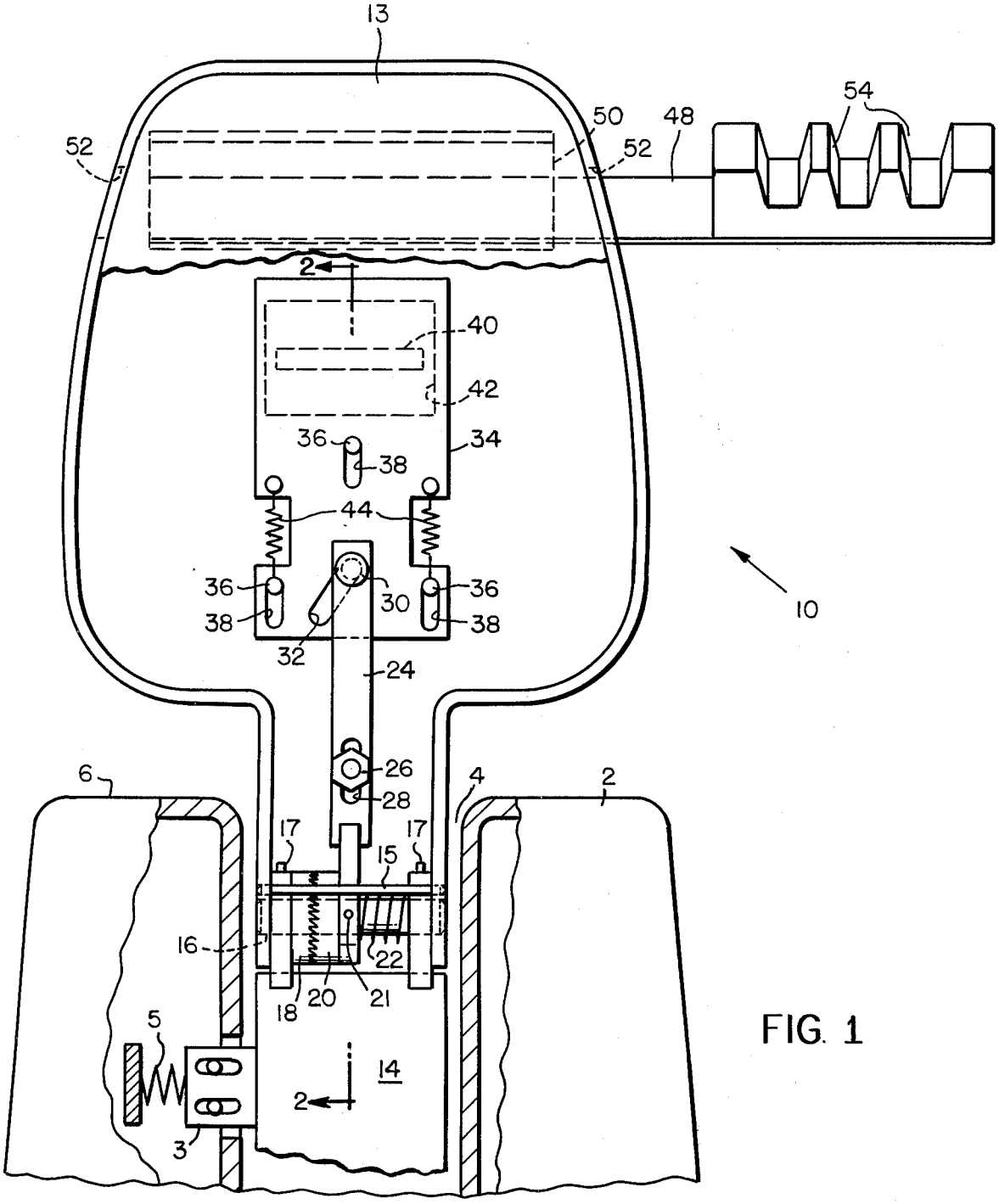
FIG. 1 is a plan view of the headrest assembly, with a portion of the cushion material removed to show the internal locking mechanism.

DESCRIPTION OF THE PREFERRED EMBODIMENTS:

Referring to the drawing, FIG. 1 shows a headrest 10 having a rear panel 12. The upholstery material, a portion of which is shown at 13, has been removed from the headrest to expose the internal components of the headrest. The headrest is journaled to a tang 14 by means of an axle pin 16 so that the headrest can articulate about the tang. The tang is in turn inserted into a backrest 2 of a dental chair. The backrest 2 has a cutout portion 4 so that the axle pin is located well below the patient's shoulder height as defined by the upper surface 6 of the backrest. With this arrangement then, the headrest can articulate about pin 16 with respect to the dental chair at a point below the patient's occipital and close to the actual pivot point of the patient's neck.

Figure 2:
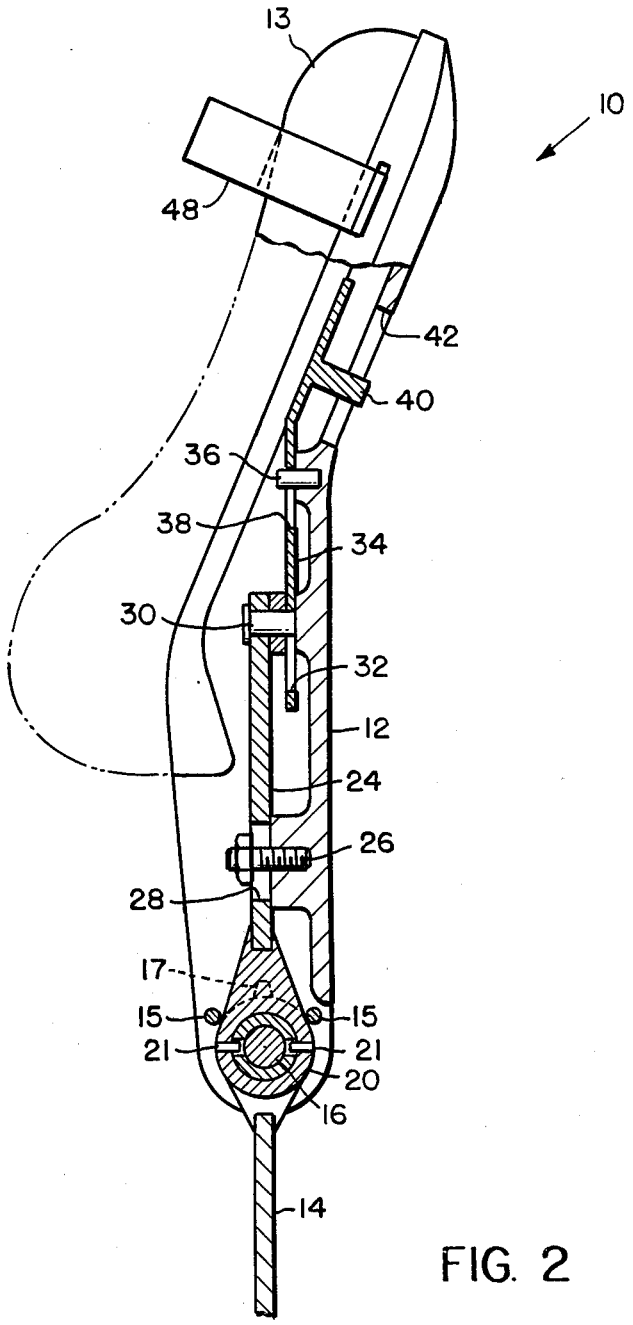
FIG. 2 is a side view of the headrest assembly including a section taken along lines 2—2 of FIG. 1.

In order to limit the articulation of the headrest, a stop dog 17 fixed to the tang is adapted to engage either of the two stop pins 15. As best seen in FIG. 2 the limits of articulation are thus defined by the engagement of one or another of stop pins 15 against dog 17.

Fixed to the tang coaxially with pin 16 is a fixed toothed clutch member 18. A second toothed clutch member 20 slidably mounted on axle pin 16 is normally urged into engagement with the fixed clutch member by a spring 22 disposed about the pin and biased between the tang and the second clutch member 20. The teeth of the clutch members are so oriented as to permit free rotation of the second clutch member over the first in one direction while preventing such rotation in the other direction. This permits the headrest to be freely movable counter clock-wise about axle pin 16 as viewed in FIG. 2 while locking the headrest against clockwise movement.

Second clutch member 20 is carried on one end of a lever arm 24 wherein connection pins 21 couple the clutch member to the lever arm. The lever arm is pivoted intermediate its ends to a pivot pin 26 fixed to rear panel 12, the pivot pin passing through an elongated slot 28 in the lever arm. Fixed to the other end of lever arm 24 is a cam follower 30.

Cam follower 30 in turn rides in a cam slot 32 formed in an actuating member 34. The actuating member is slidably mounted to rear panel 12 by means of three guide pins 36 fixed to the rear panel which extend through three parallel elongated slots 38 formed in the actuating member.

As best shown in FIG. 2, the actuating member is also provided with a depending hand grip 40 which extends through an opening 42 in the rear panel. With this arrangement, the operator can grasp the hand grip 40 and move the actuating member towards the top of the headrest. A pair of springs 44 between actuater member 34 and two of the guide pins 36 moves the actuator towards the bottom of the headrest that is towards the tang, when the hand grip is released.

In operation, and in particular, to move the headrest clockwise about axle pin 16 as viewed in FIG. 2, hand grip 40 is grasped with two or three fingers while keeping the palm on the upper end of the headrest with the thumb over the top of the headrest. With a grasping or hand closing motion the headrest is grasped and the hand grip and therefor actuating member 24 is pulled towards the top of the headrests against the bias of springs 44. As the actuating member moves upwardly cam slot 32 displaces cam follower 30 to the left as viewed in FIG. 1. This causes a counter clock-wise movement of lever arm 24 which in turn carries the second clutch member out of engagement with the fixed clutch member 18. Because axle pin 16 permits only axial movement of clutch member 20, lever arm 24 slides slightly on pivot pin 26 when clutch member 20 is moved towards or away from fixed clutch member 18. Furthermore, the loose connection between clutch member 20 and pins 21 allows the clutch member to move axially on axle pin 16 as the lever arm pivots slightly.

In any event, when actuating member 24 is moved upwards and held, clutch members 18 and 20 are disengaged and the headrest can be freely tilted downward or clockwise as viewed in FIG. 2, to any desired position.

When hand grip 40 is released, spring 22 will urge the clutch members back into engagement to lock the headrest at the adjusted position. At the same time, springs 44 will also move the actuating member towards the tang or bottom of the headrest so as to restore the position of the components to that shown in the Figures.

As the headrest is articulated, the relatively long pivot point-to-occipital distance results in a relative motion between the patient's head and the headrest. That is, as the headrest is rotated clockwise as viewed in FIG. 2, the patient's head tends to slide downward along the headrest and the opposite movement occurs when the headrest is rotated counterclockwise. In order to compensate for this relative movement, the headrest should be moved farther into the backrest or extended from the backrest as the headrest is rotated respectively clockwise and counterclockwise.

To provide for this movement while maintaining one hand operation, a simple cam friction lock is used. In this respect FIG. 1 shows a lock member 3 slidably pinned to the dental chair backrest 2. The lock member is biased by a spring 5 against tang 14. With the friction lock properly adjusted, the entire headrest can be pushed into or pulled from the backrest with one hand as the headrest is articulated. The manner of operating the lock to articulate the headrest, that is grasping the operating lever on the undersurface with the fingers while the thumb is disposed over the cushioned surface, allows the operator to grasp the headrest for pulling it from or pushing it into the backrest.

As an added feature the headrest is also provided with a sleeve 50 adjacent to its top end. The sleeve is oriented across the headrest and is adapted to receive an instrument parking bracket 48 inserted into the sleeve through an opening 52 at the side of the headrest. As one opening 52 is provided at each side of the headrest, the parking bracket can be inserted from either the left or right side of the headrest.

The parking bracket 48 contains one or more nests 54 for receiving, temporarily, any instrument which the dentist or his assistant needs to perform a particular operation.

Thus, it should be appreciated that the present invention accomplishes its intended objects in providing an articulated headrest which has low pivot point which provides for a wider range of movement of the oral cavity. Further, the headrest is easily operated with one hand and can be both articulated and moved into or out of the backrest with a minimum of effort. Not only is the headrest securely locked at the set position the toothed clutch used to lock the headrest in position also allows the positioning of the headrest at any point over its entire range of motion thus offering the dentist a wide range of set positions.

It should be appreciated that while a preferred embodiment has been described, various modifications will be obvious to one skilled in the art. For example, if pin 16 does not pass through clutch member 20, the clutch member will be free to move in an arc and out of engagement with the fixed clutch member so that elongated slot 28 can be eliminated. Further it is within the skill of the art to put cam follower 30 on actuator 34 and cam slot 32 on the lever arm. Further, while the friction lock 3 may be replaced by a manually operated lock this would detract somewhat from the one hand operation of the headrest.

Having thus described the invention in detail, what is claimed as new is:

1. A headrest for dental chairs and the like comprising:

a. a tang adapted for attachment to a dental chair;

b. a headrest journaled to said tang, said headrest including a rear panel having an opening therethrough;

c. an actuating member slidably mounted in said headrest to said rear panel, said member having a manually engageable portion extending through said opening;

d. a lever arm pivoted intermediate its ends within said headrest to said rear panel;

e. a pair of axially aligned clutch members within said headrest frame, one of said clutch members being fixed to said tang at said journal and a second of said clutch members being attached to said lever arm;

f. bias means, normally urging said clutch members into engagement to lock said headrest in position; and g. cam means on said actuating member and lever arm member cooperating to pivot said lever arm responsive to the manual movement of said actuating member for moving said second clutch member against said bias and out of engagement with said first member to unlock said headrest.

2. A headrest as in claim 1 including second bias means for urging said actuating member towards said journal so as to automatically return said actuating member to a headrest locking position when released.

3. A headrest as in claim 1 wherein said actuating member is slidably mounted to said rear panel by means of a plurality of parallel guide pins projecting through a plurality of elongated slots in said actuating member.

4. A headrest as in claim 3, wherein said second bias means are springs attached to said guide pins and said actuating means so as to urge said actuating means towards said tang.

5. A headrest as set forth in claim 1 wherein said journal includes an axle pin, said second clutch member being slidably mounted on the said axle pin.

6. A headrest as set forth in claim 1 wherein said second clutch member is carried on one end of said lever arm and said cam means is carried on the other end of said lever arm.

7. A headrest as in claim 1 wherein said cam means comprises cam slot on one of said actuating member and lever arm and a cam follower on the other.

8. A headrest as in claim 7 wherein said cam slot is on said actuating member and said cam follower is on one end of said lever arm.

9. A headrest as in claim 1 wherein said bias means is a coil spring about said axle pin and biased between said second clutch member and said tang.

10. A headrest as in claim 1 including a sleeve within said headrest adjacent to the top thereof adapted to slidably receive an instrument parking bracket, said headrest having openings at the sides thereof to permit passage of said parking bracket into said sleeve.

11. A headrest-backrest combination for dental chairs and the like comprising:

a. a backrest provided with a cut-out portion extending inward into said backrest from an upper end surface thereof;

b. a tang adapted to slidably extend into said cut-out;

c. a headrest journaled for articulation about said tang, said journal being located within said cut-out and below said backrest upper end surface so that the articulation of said headrest about said tang occurs at a point spaced from the occipital of a patient's head resting on said headrest;

d. a friction lock means on said backrest and engaging said tang, for maintaining said headrest at an adjusted spaced distance from said backrest upper end surface;

e. positive lock means within said headrest for locking said headrest at an adjusted articulated position; and f. one hand operative means for operating said positive and friction lock means to move said headrest to an adjusted articulated and spaced position with respect to said backrest.

* * * * *